US005927199A

United States Patent [19]

Achelpohl et al.

[11] Patent Number: 5,927,199

[45] Date of Patent: Jul. 27, 1999

[54] DOCTOR BLADE ARRANGEMENT FOR A RINSE INKING UNIT OF A ROTARY PRINTING MACHINE

[75] Inventors: Fritz Achelpohl; Gunter Rogge, both of Lienen, Germany

[73] Assignee: Windmoller & Holscher, Lengerich, Germany

[21] Appl. No.: 08/945,748

[22] PCT Filed: Apr. 26, 1996

[86] PCT No.: PCT/EP96/01757

§ 371 Date: Jan. 12, 1998

§ 102(e) Date: Jan. 12, 1998

[87] PCT Pub. No.: WO96/34751

PCT Pub. Date: Nov. 7, 1996

[30] Foreign Application Priority Data

May 3, 1995 [DE] Germany ..... 195 16 223

[51] Int. Cl.[6] ..... B41F 31/04; B41F 31/08

[52] U.S. Cl. ..... 101/363; 101/366

[58] Field of Search ..... 101/366, 363, 101/350.1, 157, 169, 207, 208, 209, 210, 365; 118/259, 261

[56] References Cited

U.S. PATENT DOCUMENTS 4,581,995 4/1986 Stone ..... 101/366

5,406,887 4/1995 Hertel et al. ..... 101/366

FOREIGN PATENT DOCUMENTS 40 01 733 7/1991 Germany .

40 01 734 7/1991 Germany .

89/07047 8/1989 WIPO .

93/24328 12/1993 WIPO .

*Primary Examiner*—J. Reed Fisher

*Attorney, Agent, or Firm*—Jacobson, Price, Holman & Stern, PLLC

[57] ABSTRACT

A doctor blade arrangement for a rinse inking unit of a rotary printing machine consists of a doctor blade carrier formed by a profile strip with a groove type recess. Two doctor blades adjustable at an inking roller are fixed on the doctor blade carrier almost like a roof and parallel to each other. The two doctor blades together with the inking roller, the groove type recess of the doctor blade carrier and sealings materials provided for the same at the end side border a dye chamber. In order to assure a good sealing of the dye chamber against the outcoming dye, the groove type recess is provided with a central middle part forming a main chamber and end-side side parts forming secondary chambers, which are connected with the main chamber through throttle gaps. The tube feeding the dye leads into the main chamber. The side parts are provided with the pipe lines discharging the dye and with the exhaust holes.

19 Claims, 4 Drawing Sheets

DOCTOR BLADE ARRANGEMENT FOR A RINSE INKING UNIT OF A ROTARY PRINTING MACHINE

Figure 1:
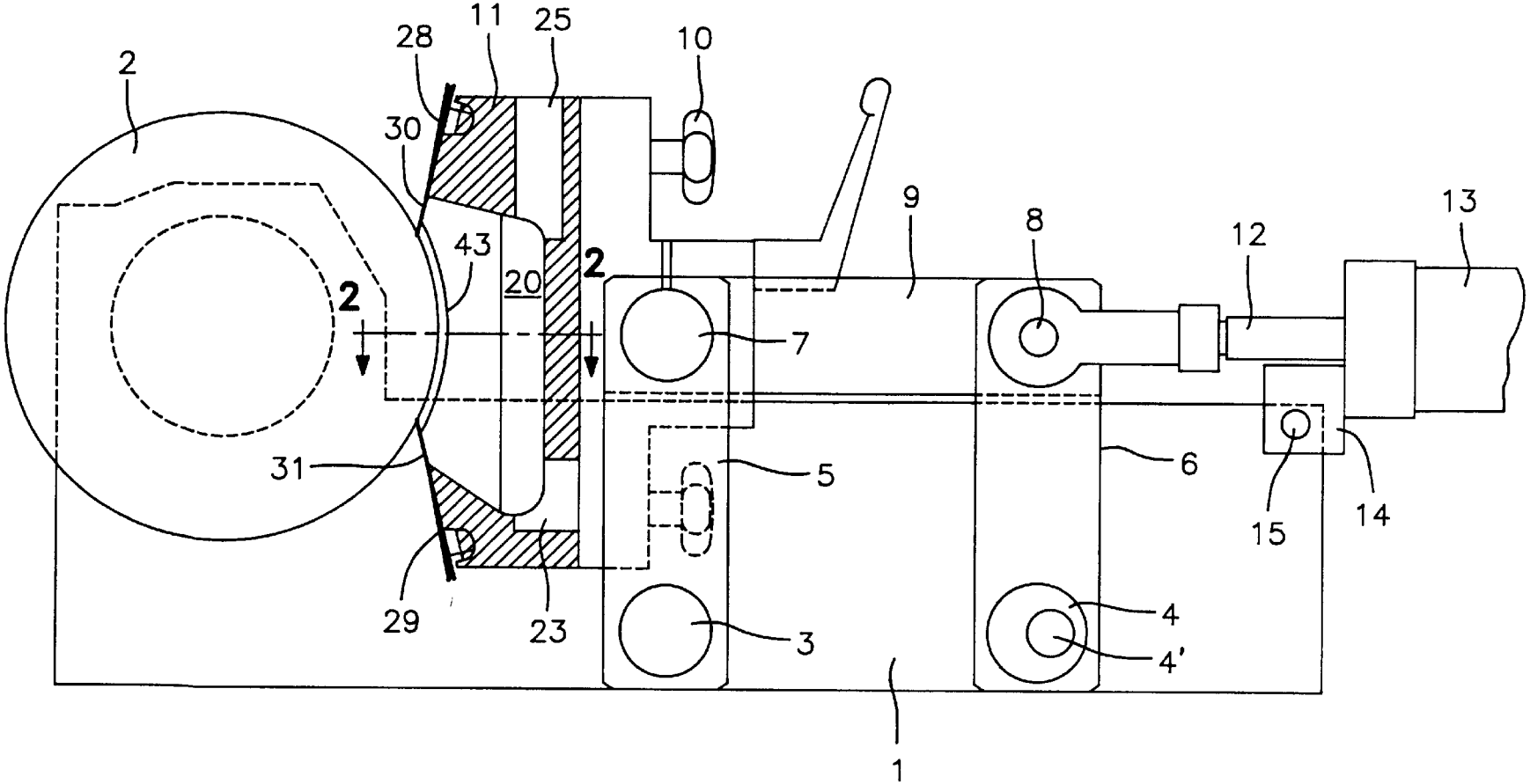

This invention relates to a doctor blade arrangement for a rinse inking unit of a rotary printing machine consisting of a doctor blade carrier formed by a profile strip with a groove type recess. Two doctor blades adjustable at an inking or raster roller are fixed on the doctor blade carrier almost like a roof and parallel to each other. The doctor blades together with the inking roller, the groove type recess of the doctor blade carrier and sealing materials provided for the same at the end side define a dye chamber. The rotary printing machine contains also tubes for feeding and discharging dye into the dye chamber and out of the same, respectively, and adjusting devices for pressing the doctor blade carrier against the inking roller.

In the case of the doctor blade arrangements of this type known from, for example, DE 40 01 733 A1 and DE 40 01 734 A1, the problem remains that, on the one hand, the dye introduction into the dye chamber should remain under certain pressure and, on the other hand, the sealing material at the side should prevent a leakage of dye from the dye chamber, so that the doctor blade arrangement is not stained by the outcoming dye and no solvent can evaporate from the dye.

The task of the present invention is therefore to design a doctor blade arrangement as stated at the outset, wherein the sealing materials provided at the end side of the doctor blade carrier assure a good sealing of the dye chamber against the outcoming dye.

According to this invention this task is solved in the case of a doctor blade arrangement of the generic type by the fact that the groove type recess is provided with a central middle part preferably extending up to its end regions and forming a main chamber, and, at the end sides, with side parts forming secondary chambers which are connected with the main chamber through throttle gaps, that the tube feeding the dye leads into the main chamber, and that the side parts are connected with the tubes discharging the dye and are provided with exhaust holes.

In the case of the doctor blade arrangement according to the invention, the desired excess pressure in the dye is maintained by passing the dye into the main chamber of the dye chamber. From the main chamber the dye enters into the depressurized secondary chamber through the throttle gaps, so that the sealings provided at the end side of the doctor blade carrier can seal the dye chamber well from the side, as sealings are not charged by dye, which is under pressure.

Advantageously, the main chamber and the secondary chambers are separated from each other by radial partition walls of the groove type recess, the edges of which are bent in the shape of an arc and, together with the raster roller, border the throttle gaps. The partition walls can be formed by rib type raisings. Furthermore the partition walls can pass over to the main chamber through the bent wall parts. Advantageously, the outer sides of the partition walls lie on radial planes.

In another design of this invention it is provided that at least one side of each of the partition walls is provided with a coating of synthetic material. Said side rises over the edges of the partition walls and with that borders the throttle gaps at the doctor blade side.

The secondary chambers can have an L-shaped cross-section in the longitudinal section of the doctor blade carrier. Advantageously, a space formed by an L-shaped part of the secondary chambers stretches in each case till below the main chamber.

The doctor blades are subject to an unavoidable abrasion, so that with their increasing erosion the radial partition walls with their edges bent in the shape of an arc and the edges bordering the throttle gaps approach towards the raster roller and the width of the throttle gaps decreases in an unwanted way.

To prevent that with increasing abrasion of the doctor blades the throttle gaps between the partition walls and the inking roller becomes smaller, according to an innovative further construction, it is provided that the partition walls bordering the throttle gaps are guided in the radial direction to the inking roller movable in the profile strip and are joined with the inking unit frame carrying the doctor blade arrangement essentially immovable by holding devices. Thus in the case of an abrasion of the doctor blades the width of the throttle gaps remains essentially constant. According to this innovative construction it is thus provided that the partition walls bordering the throttle gaps are kept immovable relative to the inking unit frame, so that those do not respond to the approach of the profile strip resulting from the abrasion of the doctor blades towards the raster roller. In this way it is guaranteed that the width of the throttle gaps between the edges of the partition wall and the raster roller remains constant, the edges of the partition walls being bent in the shape of an arc.

The essentially rigid joint of the partition walls with the inking unit frame carrying the doctor blade arrangement can be effected by different means. According to a preferred embodiment it is provided that the partition walls are joined by springy tabs or webs with the profile strip, so that they can turn backwards in a springy way corresponding to the increasing abrasion of the doctor blade.

The partition walls can be supported in each case by bars on a stopper of the dye unit box.

The bars can be led out of the profile strip through special holes or openings. It is of course useful to lead the bars out of the profile strip through the exhaust holes, as these holes are present anyway, so that no special openings or passages have to be provided for the bars.

Advantageously, the stopper can be adjusted by an adjustment device, so that there is an additional possibility to adjust the width of the throttle gaps.

Figure 3:
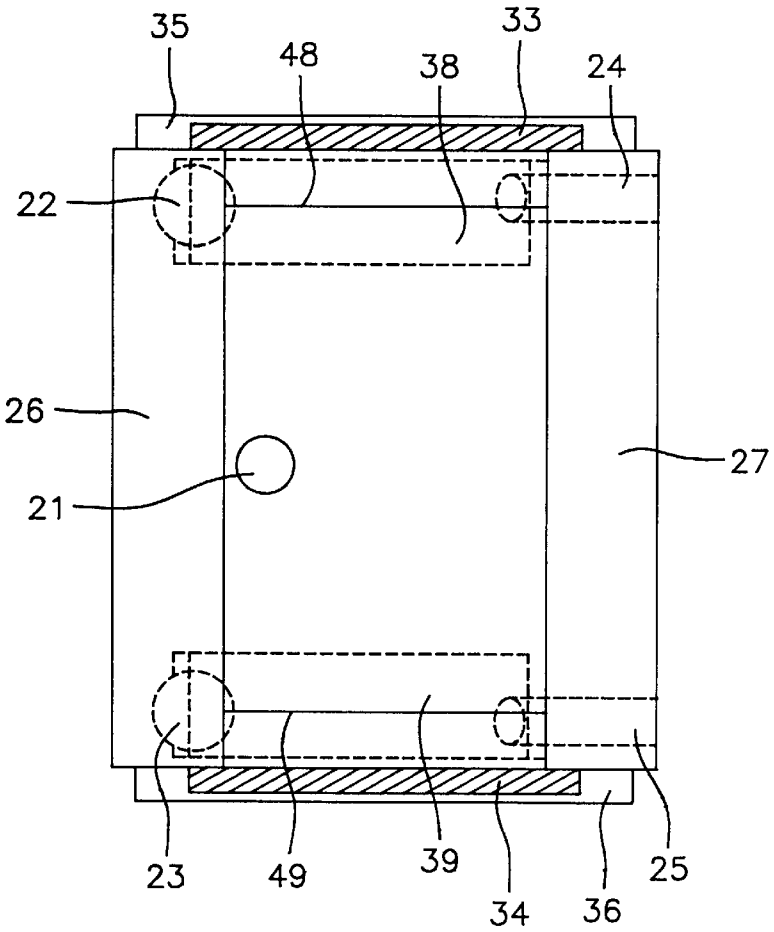
Figure 2:
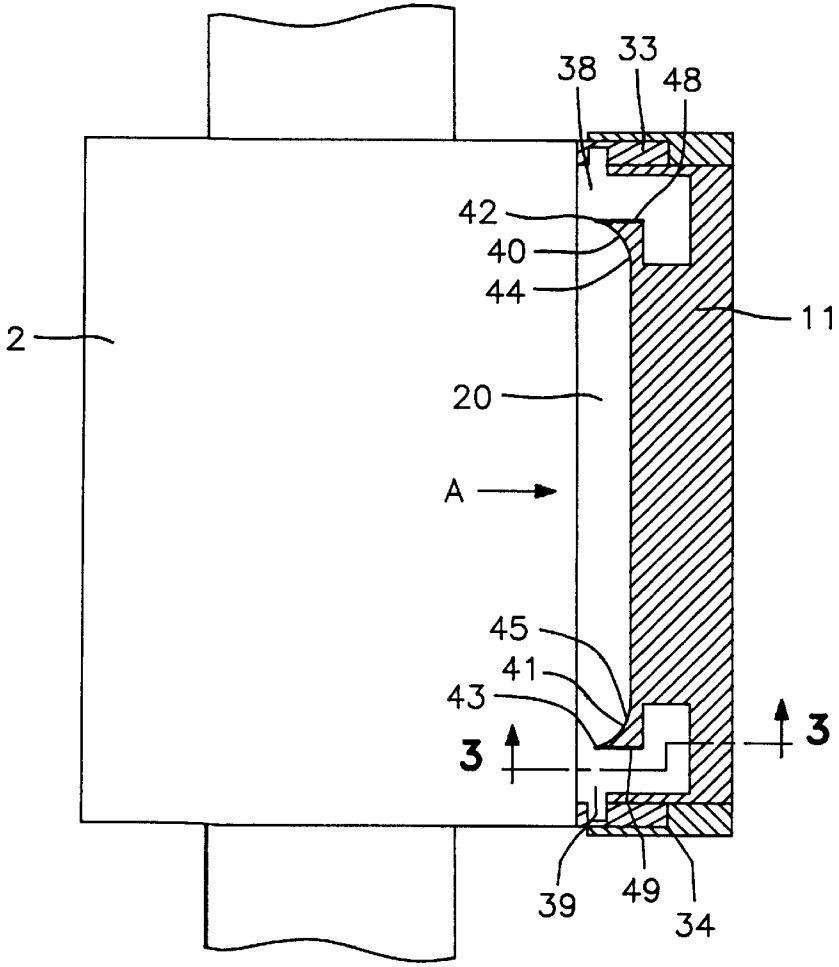

Examples of operation of this invention are explained in more details afterwards with the held of the drawings. It is shown in FIG. 1 a side view of the dye unit frame with dye chamber doctor blade sectioned along the line I—I in FIG. 2, FIG. 2 a section through the doctor blade carrier along the line II—II in FIG. 1, FIG. 3 a view of the dye chamber doctor blade in the direction of arrow A in FIG. 2, FIG. 4 a side view of the dye unit frame corresponding to FIG. 1 with sectioned dye chamber doctor blade, where the partition walls bordering the throttle gaps are kept non-shiftable relative to the dye unit frame, and FIG. 5 a section through the doctor blade carrier corresponding to FIG. 2 along line V—V in FIG. 4.

In the dye unit frame 1, which is lodged shiftable in the usual way on the printing cylinder frame constructed also as slides, one side of the raster roller 2 is lodged in the usual way and hence not described in more detail.

The parallel guide rods 5, 6 are lodged in a swivable way at the dye unit frame 1 around the articulated axles 3, 4. The upper ends of the parallel guide rods 5, 6 are joined with the carrier 9 forming a coupler swivable around the articulated axles 7, 8. The carrier 9 is constructed as a single piece which is joined by screws provided with hand wheels 10 with the doctor blade holder 11.

The piston rod 12 of a pneumatic cylinder 13 is joined flexibly with the upper ends of the parallel guide rods 6 or with the carrier 9 in the articulated axle 8. The cylinder again is linked at the dye unit frame I over a carrier piece 14 by the link 15.

While setting the doctor blades at the raster roller and while moving them off, the coupler and the doctor blade carrier 11 remain parallel to themselves, because the parallel guide rods 5, 6 have the same lengths and maintain their parallel property during theirs swings.

The articulated axle 4 of the parallel guide rod 6 is provided with an eccentric adjustment 4', on the basis of which the swiveling axis of the parallel guide rod 6 can be lifted or sunk down.

The parallel guide rods 5, 6 of each dye unit frame of the two, bearing the raster roller 2, can be designed to increase the stability doubly.

The doctor blade carrier 11 consists of a profile strip, the profile of which is evident from FIG. 1. The strip of the doctor blade carrier 11 is provided with a groove 20 forming the inside space of the dye chamber. In this groove a bore hole 21 feeding the printing ink meets in the lower middle area, as it is evident from FIG. 3. In the lower end regions the groove is cut by the bore holes 22, 23 discharging the printing ink. The exhaust holes 24, 25 meet at the upper end region of the groove.

The front sides 26, 27 of the edges of the grooves are inclined in the opposite directions like a roof. The doctor blades 30, 31 are fixed on these front areas 26, 27 by clamp holders 28, 29 in the usual way and hence not described in more details.

At the sides of the doctor blade holder 11 the sealings 33, 34 are arranged, which seal the inside space of the dye chamber 20 against the raster roller 2. To hold these sealings, covers 35, 36 are screwed with the side of the front areas of the strip of the doctor blade carrier.

The inside space of the dye chamber is provided at its sides with chambers 38, 39 having L-shapes in cross-section. These chambers are separated from the central part of the inside space of the dye chamber by partition walls 40, 41, the edges of which directing against the raster roller 2 border the gaps 42, 43 bent in the shape of an arc. Starting from the edges of the gaps 42, 43 the bent wall parts 44, 45 pass over into the central main part of the inside space of the dye chamber.

The side chambers 38, 39 are connected with the central part of the inside space of the dye chamber through the throttling gaps 42, 43. The wall parts 40, 41 thus form so-called weirs, through which the dye passed into the central part of the inside space of the dye chamber through the feed hole 21 enters under decrease of pressure into the depressurized side chambers 38, 39. In order to guarantee the unpressurized state of the chambers 38, 39, the exhaust holes 24, 25 lead into these chambers.

The outer sides of the walls 40, 41 are provided with coatings 48, 49 of synthetic material, which rise slightly above the edges bordering the gaps 42, 43, so that any metallic contact of the edges with the raster roller 2 is made impossible.

Figure 4:
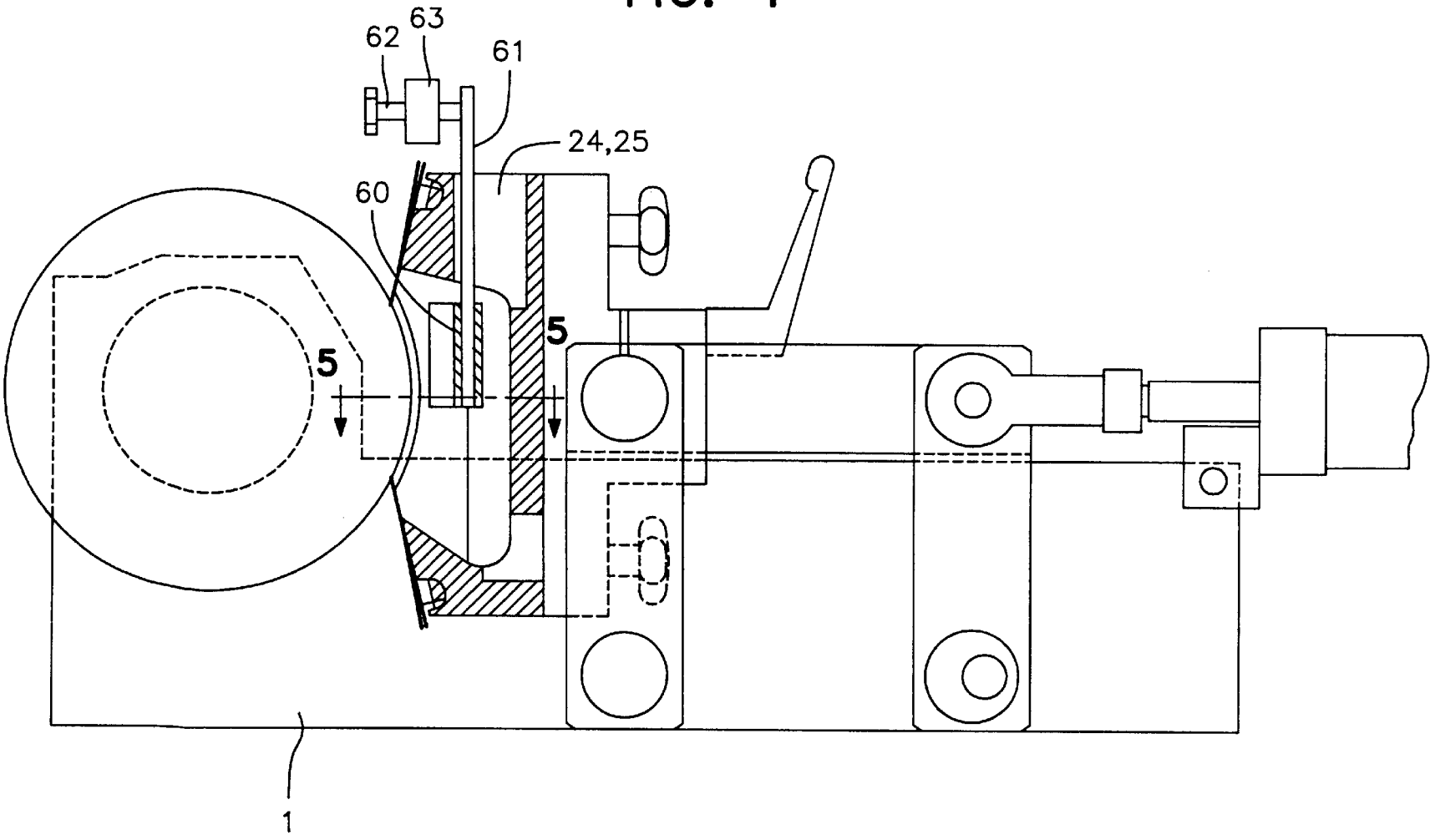
Figure 6:
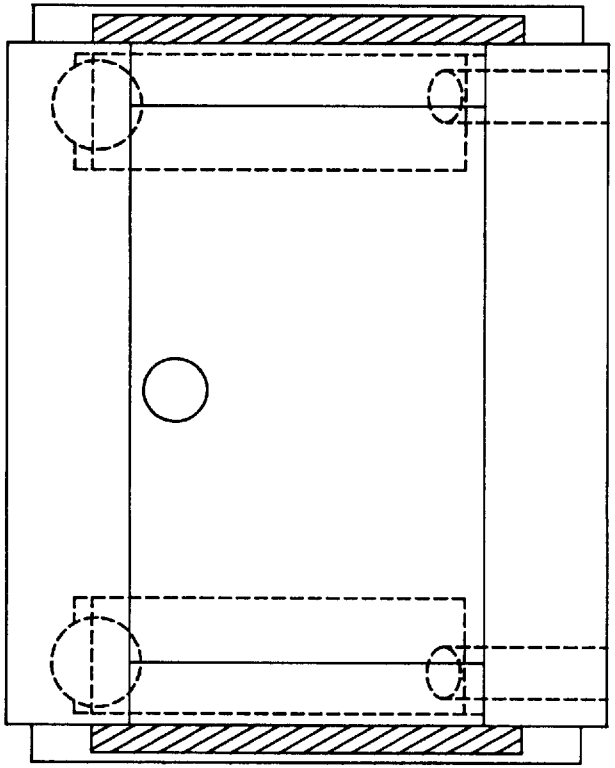
Figure 5:
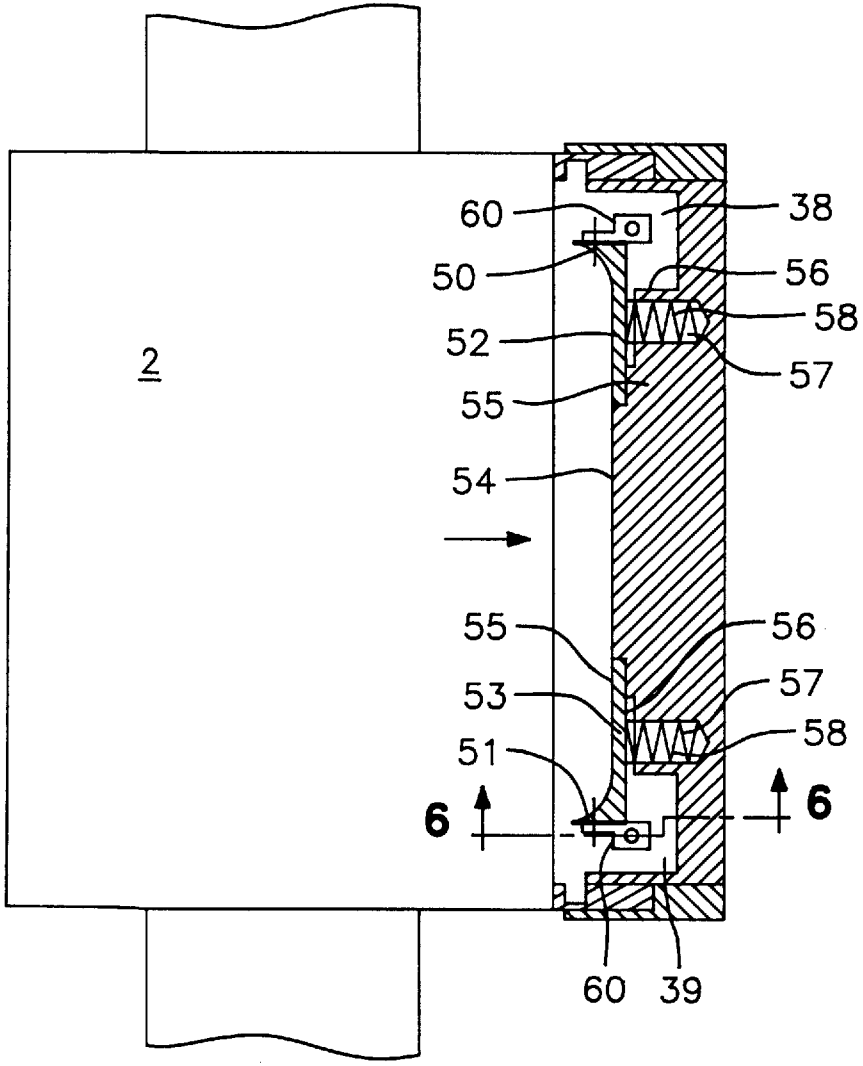

In the case of the example of the embodiment according to FIG. 4 and 5, the partition walls 50, 51 are screwed through springy spacing materials or webs 52, 53 with the base 54 of the main chamber raised compared to the secondary chambers 38, 39 at the sides. The screwings are indicated by the dotted lines 55. The springy spacing materials 52 are fitted into the corresponding steplike routings of the base 54. Moreover, recesses 56 set in the shape of steps are provided between the screwed end regions of the springy webs 52, 53 and the base, in order to permit the partition walls 50, 51 a sufficiently wide backward cushioning. Blind holes 57 are arranged in the backwalls of the base bordering the recesses 56 having the shape of steps, whereby pressure springs 58 are fixed between the grounds of these blind holes and the backside of the springy spacing materials (webs) 52, 53.

Holding pieces 60 are screwed with the front sides of the partition walls 50, 51 confining the secondary chambers. The one ends of essentially rigid bars 61 are fixed in the holding pieces in the way as evident from FIG. 4. The other ends thereof rest on an adjusting screw 62 which is screwed into a console 63 rigidly joined with the dye unit frame. The bars 61 fixing the partition walls 50, 51 relative to the dye unit frame 1 pass through the already provided exhaust holes 24, 25.

What we claim is:

1. A doctor blade arrangement for a rinse inking unit of a rotary printing machine, said doctor blade arrangement comprising:

a doctor blade carrier formed by a profile strip with a groove shaped recess, two doctor blades adjustable at an inking or raster roller being fixed on the doctor blade carrier parallel to each other, said doctor blades together with the inking roller, the groove shaped recess of the doctor blade carrier and sealing materials provided at each of two end sides define a dye chamber, tubings to feed and discharge dye into the dye chamber and out of the dye chamber, and adjusting devices to press the doctor blade carrier against the inking roller, the groove shaped recess being provided with a central middle part extending up to its end regions and forming a main chamber and, at the end sides, with side parts forming secondary chambers, said side parts being connected with the main chamber through throttle gap for maintaining pressure in the dye and allowing the dye to enter into the depressurized secondary chambers through the throttle gaps, a pipe line feeding the dye leading into the main chamber, and the side parts being provided with pipe lines discharging the dye and with exhaust holes.

2. The doctor blade arrangement according to claim 1, wherein the main chamber and the secondary chambers are separated from each other by radial partition walls of the groove shaped recess, and arc type bent edges of the groove shaped recess border the throttle gap with the raster roller.

3. The doctor blade arrangement according to claim 1, wherein partition walls are formed by rib type raisings.

4. The doctor blade arrangement according to claim 1, wherein partition walls pass over through bent parts into the main chamber.

5. The doctor blade arrangement according to claim 1, wherein outer sides of partition walls lie on radial planes.

6. The doctor blade arrangement according to claim 3, wherein at least one side of each of the partition walls is provided with a coating of synthetic material, which rises above edges of the partition walls and with that borders the throttle gaps at a side of the doctor blade.

7. The doctor blade arrangement according to claim 1, wherein the secondary chambers have an L-shaped cross-section in a longitudinal section of the doctor blade carrier.

8. The doctor blade arrangement according to claim 7, wherein a space formed in each case by an L-leg of the secondary chambers stretches until reaching below the main chamber.

9. The doctor blade arrangement according to claim 2, wherein the partition walls bordering the throttle gaps are guided in a radial direction to the inking roller movable in the profile strip and are joined over holding devices immovable with a dye unit frame carrying the doctor blade arrangement, so that in the case of an abrasion of the doctor blades a width of the throttle gaps remains essentially constant.

10. The doctor blade arrangement according to claim 9, wherein the partition walls are joined with the profile strip by springy tongues or spacing materials.

11. The doctor blade arrangement according to claim 9, wherein the partition walls are each supported on a stopper of the dye unit frame via a bar .

12. The doctor blade arrangement according to the claim 11, wherein the bars are projected out of the profile strip through the exhaust holes.

13. The doctor blade arrangement according to claim 11, wherein the stopper can be adjusted by an adjusting device.

14. A doctor blade arrangement for a rinse inking unit of a rotary printing machine, said doctor blade arrangement comprising:

a doctor blade carrier formed by a profile strip with a groove shaped recess, two doctor blades adjustable at an inking or raster roller being fixed on the doctor blade carrier parallel to each other, said doctor blades together with the inking roller, the groove shaped recess of the doctor blade carrier and sealing materials provided at each of two end sides define a dye chamber, the groove shaped recess being provided with a central middle part extending up to its end regions and forming a main chamber and, at the end sides, with side-parts forming secondary chambers, said side-parts being connected with the main chamber through throttle gaps for maintaining pressure in the dye and allowing the dye to enter into the depressurized secondary chambers through the throttle gaps, the side parts being provided with pipe lines discharging the dye and with exhaust holes.

15. The doctor blade arrangement according to claim 14, wherein the main chamber and the secondary chambers are separated from each other by radial partition walls of the groove shaped recess, and arc type bent edges of the groove shaped recess border a throttle gap with the raster roller.

16. The doctor blade arrangement according to claim 14, wherein partition walls are formed by rib type raisings.

17. The doctor blade arrangement according to claim 14, wherein partition walls pass over through bent parts into the main chamber.

18. The doctor blade arrangement according to claim 17, wherein at least one side of each of the partition walls is provided with a coating of synthetic material, which rises above edges of the partition walls and with that borders the throttle gaps at a side of doctor blade.

19. The doctor blade arrangement according to claim 14, wherein the partition walls bordering the throttle gaps are guided in a radial direction to the inking roller movable in the profile strip and are joined over holding devices immovable with a dye unit frame carrying the doctor blade arrangement, so that in the case of an abrasion of the doctor blades a width of the throttle gaps remains essentially constant.

* * * * *